United States Patent [19]

Moritani et al.

[11] 4,246,650

[45] Jan. 20, 1981

[54] MULTI-FUNCTION ELECTRONIC TIMEPIECE

[75] Inventors: Nakanobu Moritani; Hajime Oda, both of Tokyo, Japan

[73] Assignee: Kabushiki Kaisha Seikosha, Tokyo, Japan

[21] Appl. No.: 922,493

[22] Filed: Jul. 6, 1978

[30] Foreign Application Priority Data

Jul. 5, 1977 [JP] Japan ..... 52-80318

[51] Int. Cl.[3] ..... G04G 13/02; G04G 5/02; G04F 10/00; G04F 3/06

[52] U.S. Cl. ..... 368/69; 368/72; 368/109; 368/111; 368/188

[58] Field of Search ..... 58/23 R, 38, 39, 39.5, 58/58, 74, 85.5

[56] References Cited

U.S. PATENT DOCUMENTS

| | | | |
|---|---|---|---|
| 3,813,533 | 5/1974 | Cone et al. | 58/50 R |
| 3,852,952 | 12/1974 | Vittoz | 58/85.5 |

*Primary Examiner*—Edith S. Jackmon

*Attorney, Agent, or Firm*—Robert E. Burns; Emmanuel J. Lobato; Bruce L. Adams

[57] ABSTRACT

The disclosed is an electronic timepiece which has storage circuits for respectively storing data regarding a variety of times such as an alarm time for different operating modes, stop watch, timer, etc., a data processing circuit commonly provided for all the storage circuits for executing various time processes, and a control circuit for controlling a mutual transfer of the data between the respective storage circuits and the data processing circuit to selectively process the various times. Accordingly, this timepiece can process a large number of times without increasing the number of the time processing circuits.

4 Claims, 3 Drawing Figures

MULTI-FUNCTION ELECTRONIC TIMEPIECE

BACKGROUND OF THE INVENTION

A number of conventional digital electronic timepieces have a present clock timing function, and additional functions such as an alarm, stop watch and timer functions. Each of these additional functions independently has a time processing circuit. Since the increase of the additional functions requires the number of time processing circuits specific for their functions to be increased, the circuit configuration becomes complicated and accordingly expensive.

SUMMARY OF THE INVENTION

This invention relates to an electronic timepiece which incorporates a variety of time functions and, more particularly, to the a time processing circuit commonly provided for the various time functions.

It is, therefore, an object of the present invention to provide an electronic timepiece which selectively executes timing processes regarding a plurality of times by a common time processing circuit to effect the timing processes of plural additional functions with a simple circuit configuration.

It is another object of the present invention to provide an electronic timepiece which can extremely rapidly process a content of additional functions such as setting of time or the clock using an up-down counter as a time processing circuit.

It is a further object of this invention to provide an electronic timepiece which adjusts the present time by a time processing circuit and sets the adjusted content in a counter for counting the present time for the adjustment of the time with a simple circuit configuration by using the time processing circuit commonly for adjusting the present time.

It is still another object of the invention to provide an electronic timepiece which easily recognizes the content of the time selected at present by constructing a display section with main and sub display units and indicating the content of the selected additional function on the main display unit and present time on the sub display unit.

DESCRIPTION OF THE PREFERRED EMBODIMENTS

Figure 1A:
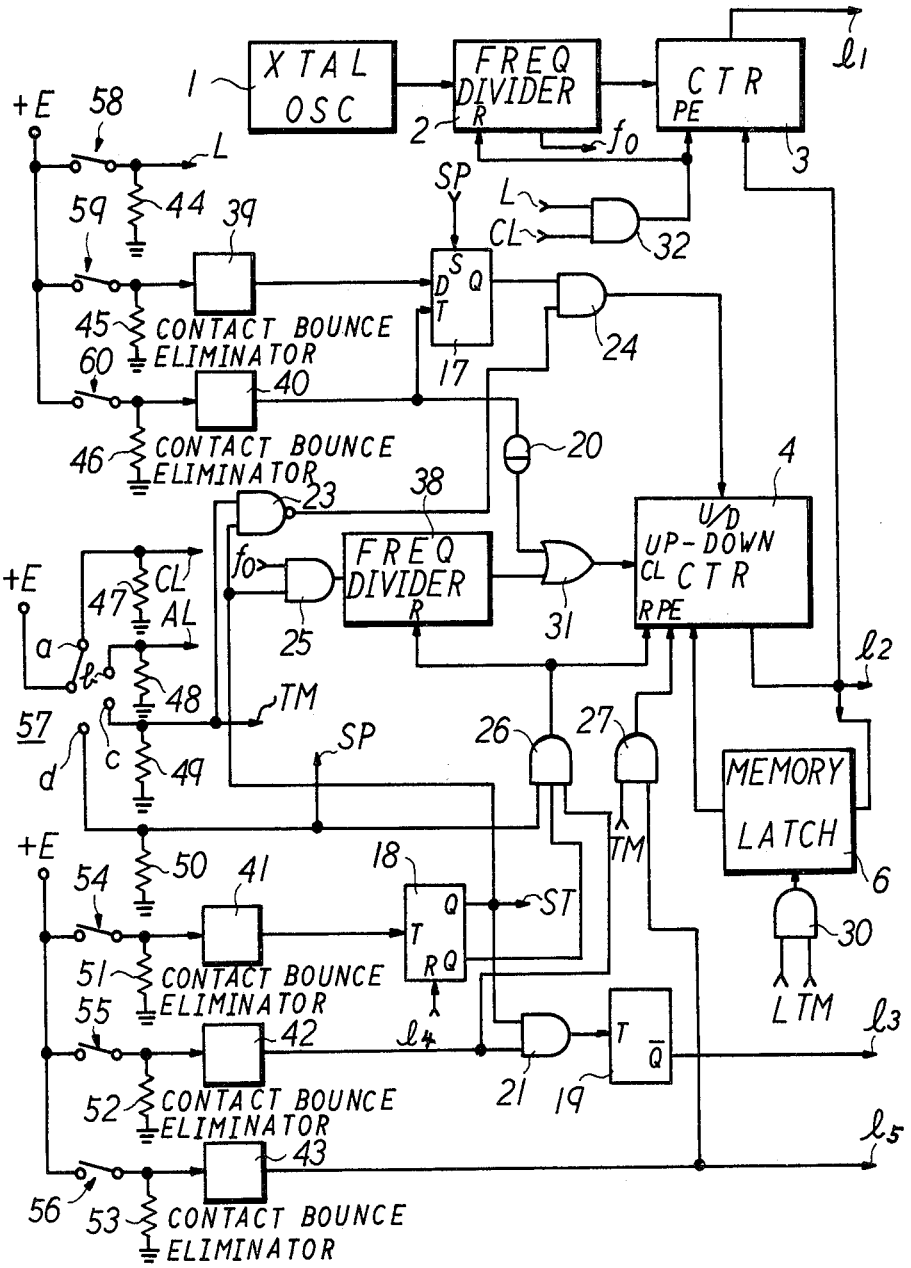
FIGS. 1A and 1B are block diagrams of one preferred embodiment of the present invention.
Figure 1B:
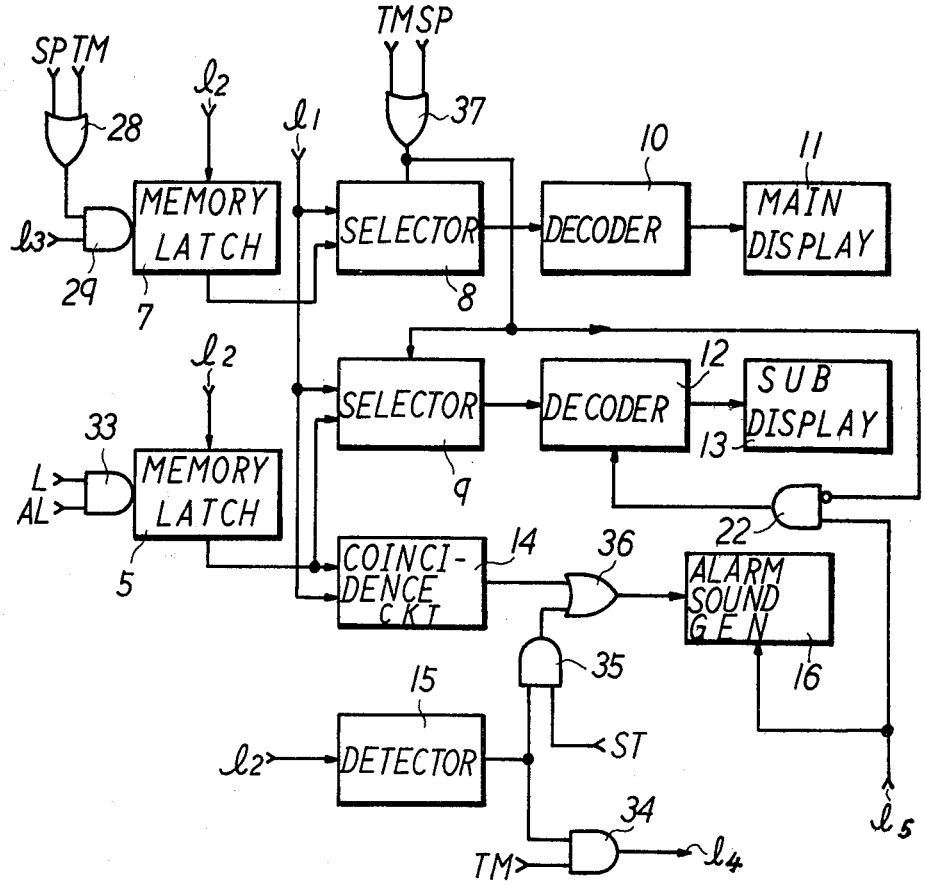

In FIGS. 1A and 1B, the output frequency of a crystal oscillator 1 is reduced by a frequency divider 2, which thereupon produces a frequency fo and, a time standard frequency to be supplied to a counter 3 capable of being preset for counting a time. An up-down counter 4 capable of being preset executes a variety of timing processes. Memory latches 5, 6 and 7 temporarily store time regarding alarm, timer and stop watch functions, respectively. A selector 8 is composed of gate circuits and selects either the counted output from the counter 3 or output from the memory latch 7. A selector 9 selects either the counter output from the counter 3 or output from the memory latch 5. The output of the selector 8 is applied to and indicated by a main display unit 11 through a decoder 10, and the output of the selector 9 is applied to and indicated by a sub display unit 13 through a decoder 12. A coincidence circuit 14 produces a coincidence output when the output of the memory latch 5 coincides with the output of the counter 3. A detector 15 produces a detected output upon reception of the output from the up-down counter 4 when the counted content of the up-down counter 4 is "0". Reference numeral 16 indicates an alarm sound generator, 17 to 19 flip-flop circuits, 20 a delay circuit, 21 to 37 gate circuits, and 38 a frequency divider. Contact bounce eliminators 39 to 43 are effective to remove the contact bounce signal which occurs when a mechanical switch is opened or closed and to produce an output of only the contact opening and closure signal. For example, these contact bounce eliminators 39 to 43 may be composed of shift registers or flip-flop circuits, which are known in the prior art. Reference numerals 44 to 53 represent resistors, and reference symbol E indicates a DC power source. A manual switch 54 controls the starting or stopping operation of the stop watch and timer functions, a manual switch 55 controls the starting or stopping operation of the measurement of a lap time and generation of a reset signal, and a manual switch 56 controls the stopping of an alarm sound. A rotary switch 57 selects any one of a time adjustment, alarm, timer and stop watch modes. A switch 58 produces a control signal for controlling the gate circuit 32, and switches 59 and 60 control a quick time adjustment with a structure as shown in FIG. 2.

Figure 2:
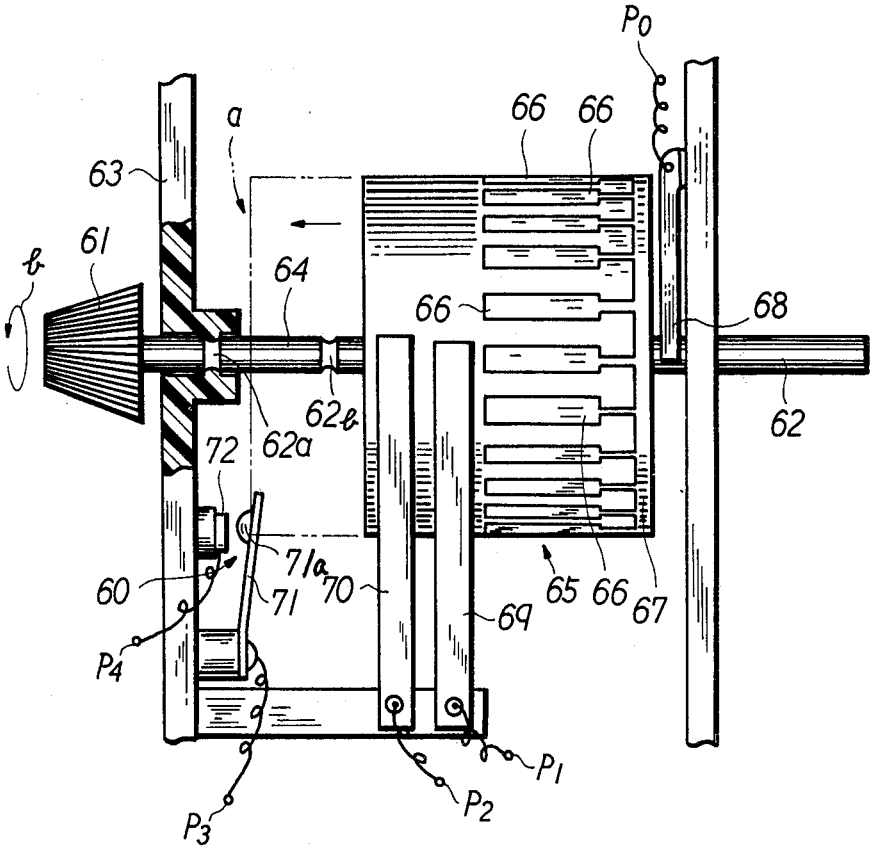
FIG. 2 is a front view partly in section of one example of the switch shown in FIG. 1A.

In FIG. 2, a knob 61 is secured to the end of a shaft 62, on which engaging grooves 62*a*, 62*b* are formed to engage a pawl 64 formed at a supporting plate 63. A cylindrical rotor 65 is also secured to the shaft 62. Electrodes 66, . . . , 66 are formed on the rotor 65, are electrically connected via a common electrode 67 to the shaft 62, and further connected through a contact piece 68 elastically making contact with the shaft 62 and terminal Po to the DC power source E. Contact pieces 69 and 70 formed of electroconductive material and of different length elastically make contact with the rotor 65 and are connected to the earth at their terminals $P_1$ and $P_2$ via resistors, respectively. The switch 59 in FIG. 1A is composed of the contact piece 69 and electrodes 66, . . . , 66 and the switch 60 is composed of the contact piece 70 and electrodes 66, . . . , 66. A contact 71*a* is connected through a contact piece 71, terminal $P_3$ and resistor to the earth, and a contact 72 is connected via a terminal $P_4$ to the DC power source. The switch 58 is composed of the contacts 71*a* and 72 as shown in FIG. 1A.

The operation of the configuration thus formed will be described next. In the initial state, it is assumed that in FIG. 1A, the switches 54 to 56 are opened and the switch 57 is set at the contact a or b, and that the flip-flop circuits 18 and 19 are reset. In this condition, as the knob 61 shown in FIG. 2 is then pushed forwardly as shown, the contacts 71*a* and 72 are opened, and the switch 58 shown in FIG. 1A is also opened. Accordingly, a logic value "0" is applied to one input (L) of the AND gate 32, which thereupon produces a logic value "0", which is then applied to the frequency divider 2 to release the reset condition of the divider 2. Thus, the frequency divider 2 operates to reduce the input frequency and to produce an output, which is then applied to the counter 3 to count the time. The output of the counter 3 is supplied to the selector 8 in FIG. 1B. Since the switch 57 produces a logic value "0" at its contacts c and d (TM and SP) in FIG. 1A, these outputs "0" are applied to both inputs (TM and SP) of the OR gate 37, which thereupon produces an output "0" in FIG. 1B, which is applied to the selector 8, which thereupon selects the output from the counter 3. Accordingly, the counted output from the counter 3 is supplied through the selector 8 and decoder 10 to the main display unit 11, which indicates the present time.

The setting operation of an alarm time will now be described. The switch 57 is set at the contact b (AL) to supply a logic value "1" to one input (AL) of the AND gate 33. Then, the knob 61 in FIG. 2 is pulled to pull the rotor 65 to the position indicated by a two-dotted broken line a so as to enable the contact pieces 69, 70 to be in contact with the electrodes 66, . . . , 66 and to bring into contact the contacts 71*a* and 72 to close the switch 58 in FIG. 1A. Thus, a logic value "1" is applied from the switch 58 (L) to the other input (L) of the AND gate 33, which thereupon produces a logic value "1", which is then applied to the memory latch 5, which is set to be enabled to store its input data. Accordingly, the counter content ($l_2$) of the up-down counter 4 is stored in the memory latch 5, and the output thereof is supplied to the selector 9. Since the output of the OR gate 37 remains at a logical value "0", the selector 9 selects the output of the memory latch 5. Thus, the counted output from the up-down counter 4 is supplied through the memory latch 5, selector 9 and decoder 12 to the sub display unit 13, which thereupon indicates the output from the counter 4. When the knob 61 in FIG. 2 is then rotated in the direction of an arrow b, the contact piece 69 comes into contact with each of the electrodes 66, . . . , 66, and the piece 70 then comes into contact with the electrodes 66, . . . , 66, slightly later. Accordingly, a pulse is produced first from the contact bounce eliminator 39 and a pulse is then produced from the contact bounce eliminator 40 slightly later. These pulses are applied to the inputs of the flip-flop circuit 17 to keep the output Q thereof at a logic value "1", and thus the up-down counter 4 is switched an up-count mode by the output of the gate 24. The aforementioned pulse from the bounce 40 is also applied to and delayed by the delay circuit 20 slightly, and is then supplied through the OR gate 31 to the up-down counter 4 to advance the content thereof. Thus, the content of the counter 4 is advanced by the incoming pulses in response to the rotating speed of the knob 61 in FIG. 2 to adjust the contest of counter 4 to a desired time.

Although the alarm time is set by advancing the content of the up-down counter as 4 in the above description, the knob 61 should be rotated oppositely to the direction illustrated above in FIG. 2 if the alarm time can be set faster by decreasing the content of the counter 4. Thus, the contact pieces 70 and 69 can be sequentially brought into contact with the electrodes 66, . . . , 66 inversely to the above case. Then, the output Q of the flip-flop circuit 17 in FIG. 1A turns a logic value "0". Accordingly, the counter 4 is switched to a down count mode to decrease the content thereof.

When the alarm time is thus set, the switch 58 is opened to invert its output from a logic value "1" to "0" (L), which is applied to the one input (L) of the AND gate 33 to hold the content of the memory latch 5 at the alarm time set as above. Then, when the time is elapsed and the content of the counter 3 coincides with that of the memory latch 5, the output of the coincidence circuit 14 is inverted from a logic value "0" to "1", which is applied through the OR gate 36 to the alarm sound generator 16, which thereupon generates an alarm sound. When the alarm stop switch 56 is then closed, a logic value "1" is applied through the contact bounce eliminator 53 ($l_5$) to the generator 16 to stop the alarm sound and is also applied to one input of the INHIBIT gate 22. Since a logic value "0" is applied from the gate 37 to the inhibit input of the gate 22, the gate 22 produces a logic value "1" upon reception of the logic value "1" from the switch 56. Thus, the logic value "1" is applied from the gate 22 to the decoder 12. Accordingly, the fact that the alarm sound is stopped is thus indicated on the sub display unit 13 through the decoder 12. This may cancel the indication of the alarm time without indicating the alarm sound stop.

Accordingly, when the switch 56 is closed to stop the alarm sound, it is indicated on the sub display unit 13. When the switch 56 is opened to set the alarm sound, the alarm time is indicated on the sub display unit 13.

A time correcting operation will now be described. The switch 57 is set at the contact a in FIG. 1A, and a logic value "1" (CL) is applied to the other input (CL) of the gate 32. Then, the knob 61 is pulled as described above in FIG. 2 to close the switch 58 to thus invert the output of the gate 32 to a logic value "1". Thus, the frequency divider 2 is reset by the output of the gate 32, and the counter 3 is set to the presettable condition, by which the content of the up-down counter 4 is stored in the counter 3. Then, after the content of the counter 4 is set to desired time by turning the knob 61 in FIG. 2, the knob 61 is pushed to open the switch 58. Thus, it releases the reset of the frequency divider 2 and prohibits the counter 3 to preset. Then, it starts to count from the desired time.

The stop watch function will now be described next. The switch 57 is set at its contact d, and a logic value "1" (SP) is applied to the set (S) terminal of the flip-flop circuit 17 to set the flip-flop circuit 17, so that the up-down counter 4 is kept at the up-count mode by the output of the gate 24. In the meanwhile, by the closure of the switch 57, one input of the gate 26 is inverted to a logic value "1" and the outputs of the gate 28 and 37 to a logic value "1". As the above output level of the gate 28 is inverted, the output of the gate 29 is inverted to a logic value "0" to allow the memory latch 7 to store the input data thereof. In addition, the selectors 8, 9 select the outputs of the memory latch 7 and the counter 3 respectively as a result of the above inverted output level of the gate 37. Accordingly, the content of the counter 4 is supplied through the memory latch 7, selector 8 and decoder 10 to the main display unit 11, which thereupon indicates it. The inverted output logic value "1" of the gate 37 keeps the output of the gate 22 at a logic value "0". Accordingly, even if the alarm stop switch 57 is closed to stop the alarm sound, the decoder 12 receives the counted output from the counter 3 through the selector 9 and the counted output thereof is indicated by the sub display unit 13. When this timepiece is used as a stop watch, the contents of the up-down counter 4 and counter 3 are indicated on the main and sub display units 11 and 13, respectively.

The switch 55 is initially closed to supply a logic value "1", thereby inverting the output of the gate 26 to a logic value "1" and resetting both the frequency divider 38 and the up-down counter 4. As the switch 54 is closed after the switch 55 is opened, the output Q of the flip-flop circuit 18 is inverted a logic value "1" to open the gate 25. Consequently, the output pulses from the frequency divider 2 are supplied to the frequency divider 38 through the gate 25 and the pulses from the frequency divider 38 are supplied to the up-down counter 4 through the gate 31. The counter 4 thus starts to count the incoming pulses and to then supply its output ($l_2$) through the memory latch 7, selector 8, and decoder 10 to the main display 11, as described above, which indicates the counted content in the counter 4. In order to stop the counting, the switch 54 is again closed to allow the flip-flop circuit 18 to invert its output Q to a logic value "0", by which the gate 25 is closed.

When counting a lap time, the switch 54 is closed to select the state wherein the flip-flop circuit 18 is set to develop values for outputs Q and $\overline{Q}$ of "1" and "0", respectively and the up-down counter 4 is counting. Consequently, the output of the gate 21 is inverted to a logic value "1" to trigger the flip-flop circuit 19, and the output $\overline{Q}$ thereof is inverted to a logic value "0". Thus, the output of the gate 29 is inverted to a logic value "0", the memory latch 7 holds its content at this time, while the up-down counter 4 continues its counting. In this manner, the lap time is measured.

When resetting the timepiece, the switch 55 is closed in the state that the counting operation is stopped, by which the output of the gate 26 is inverted to a logic value "1" to reset the frequency divider 38 and up-down counter 4.

The operating mode wherein the timepiece is used as a timer will be described. The switch 57 is closed at its contact c to supply a logic value "1" (TM) to the inputs (TM) of the gates 23, 27, 30 and 34. In addition, the output of the gate 28 is also inverted to a logic value "1" to invert the output of the gate 29 to a logic value "1", thereby enabling the memory latch 7 to store the input data thereof. In the meanwhile, since the output of the gate 37 is inverted to a logic value "1", the contents of the counter 3 and up-down counter 4 are indicated by the display units 11 and 13 respectively in the same manner as described above. Then the switch 58 is closed, a logic value "1" (L) is supplied to the other input (L) of the gate 30 to allow the gate 30 to produce its output "1", which enables the memory latch 6 to store the input data thereof.

Then, a desired time can be set at the up-down counter 4 by turning the knob 61 in FIG. 2. After the desired time is stored in the memory latch 6, the switch 58 is opened and the switch 54 is then closed to invert the output Q of the flip-flop circuit 18 to a logic value "1" (ST). Accordingly, the one input of the gate 35 and the output of the gate 23 are inverted to logic values "1" and "0" respectively and further the output of the gate 24 is inverted to a logic value "0". Therefore, the up-down counter 4 is changed to a down count mode. In the meanwhile, the gate 25 is opened by the aforementioned inverted level of the output Q of the flip-flop circuit 18. Thus, the output pulse fo from the frequency divider 2 is supplied through the gate 25 to the frequency divider 38, which, in turn, supplies its output through the OR gate 31 to the up-down counter 4, which thereupon starts down counting. As the desired time thus set as described above is elapsed, the content of the up-down counter 4 becomes zero and a logic value "0" at its output ($l_2$) is developed and is applied to the detector 15, the output thereof is inverted to a logic value "1", thereby inverting each of the outputs of the gates 34 and 35 to a logic value "1". Thus, the output logic value "1" of the gate 35 is supplied through the OR gate 36 to the alarm sound generator 16 and the output of the gate 34 is also supplied to the reset (R ) terminal ($l_4$) of the flip-flop circuit 18 to reset the flip-flop circuit 18 to allow the flip-flow circuit 18 to invert its output Q from a logic value "1" to "0" (ST) to stop counting in the counter 4. As the alarm sound stop switch 56 is then closed, a logic value "1" ($l_5$) is applied to the alarm sound generator 16 to stop generation of the alarm sound and is also supplied to one input of the AND gate 27 to allow the gate 27 to invert its output to a logic value "1", which is applied to the up-down counter 4 to allow the counter 4 to store the content of the memory latch 6, i.e., desired time set previously. If the timer is again desired to start operation, the switch 54 is closed to allow the counter 4 to start down counting in the same manner as described above to repeat the operation as described above.

If the timer is desired to be temporarily stopped during its operation, the switch 54 is closed to allow the flip-flop circuit 18 to invert its output Q, which is applied to the input of the AND gate 25 to allow the gate 25 to close to stop supplying the output pulse fo from the frequency divider 2 through the gate 25, frequency divider 38, and gate 31 to the up-down counter 4.

If this timepiece is so set as to repeatedly operate the timer function as described above, the time may be stored only initially in the memory latch 6, but may not be set after successive lapses of the set time to provide a simple operation. However, if this function is not necessary in the timepiece, the memory latch 6 may be removed therefrom, and in case that the timer function is operated, the time may be set in the up-down counter 4 every time.

Although the up-down counter 4 is set to advance the counted content at that time to the desired time when the time is corrected in the above embodiment, the correcting counting may be reduced to correct the up-down counter 4 faster than that in the previous embodiment if the content of the counter 3 is preset in the up-down counter 4 at the time correcting time and the counter 4 is set to advance the content from the preset content.

It is to be noted that although the switch mechanism shown in FIG. 2 is used to alter the content of the up-down counter 4 in the above embodiment, the content of the counter 4 may also be converted, for example, by selecting up or down counting of the counter 4 by one manual switch and supplying a pulse signal to the counter 4 by the manipulation of another manual switch.

It is also to be noted that an up counter may also be used instead of the up-down counter 4.

It should be noted that although the stop watch, timer and alarm time functions have been described as the additional functions of the timepiece in the above embodiment, this invention may be applied to the time processings of a world time timepiece. In this case, the content of the counter 3 is transferred to the up-down counter 4 by switching operation, and the content of the counter 4 is indicated by correcting the content of the counter 4 in the amount of the time difference between a standard time and a local time.

It is to be noted that though the time correction is effected by presetting the content of the up-down counter 4 in the counter 3 in the above embodiment, an up-down counter is used instead of the counter 3 to directly correct the content of the counter 4 by manual operation.

Since the electronic timepiece of the present invention counts the content of the additional function selected from the contents of a plurality of additional functions stored in the memory means in the second counting means to control the mutual transfer between the counted content of the second counting means and the content of the memory means in the foregoing description, the countings of a stop watch, timer, etc. and setting of an alarm time can be selectively effected by the common counting means, so that a plurality of additional functions can be selected with a simple circuit configuration effective particularly for a compact timepiece.

If an up-down counter is used for the second counting means, time can be set with a simple configuration rapidly in the case, for example, that timer and alarm watch functions are selectively executed as the additional functions.

If the configuration of this timepiece is so constructed that the content of the up-down counter may be preset in a preset counter for counting the time, a simple up counter may be used as the preset counter and the content of the preset counter can be arbitrarily advanced or delayed in its correction.

If present and alarm times are normally indicated on the main and sub display means and a time value of additional functions such as stop watch and timer functions or the like is indicated on the main display means and present time is indicated on the sub display means when the additional functions are selected, the content of the additional functions selected at present is indicated on the main display means to be readily readable when indicated.

What we claim is:

1. An electronic multi-function timepiece, comprising: first counting means for developing a count representative of time; storage means for simultaneously storing a plurality of counts corresponding to a plurality of additional functions of the timepiece; selecting means connected to said storage means for selecting any of the additional timepiece functions; second counting means for developing a count corresponding to the additional function selected by said selecting means; and control means for controlling mutual transfer of counts between said second counting means and said storage means.

2. An electronic timepiece according to claim 1, wherein said second counting means is an up-down counter.

3. An electronic multi-function timepiece, comprising: a preset counter for developing a count representative of time; storage means for simultaneously storing a plurality of counts corresponding to a plurality of additional functions including a time correcting function of the timepiece; selecting means connected to said storage means for selecting any of the additional timepiece functions; second counting means for developing a count corresponding to the additional function selected by said selecting means; control means for controlling mutual transfer of counts between said second counting means and said storage means; and correcting means for allowing said selecting means to select the time correcting function and for storing a desired time adjusted by said second counting means in said preset counter.

4. An electronic multi-function timepiece, comprising: a preset counter for developing a count representative of time; storage means for storing a plurality of counts corresponding to a plurality of additional functions including a time correcting function and an alarm time function of the timepiece; selecting means for selecting any of the additional timepiece functions; second counting means for developing a count corresponding to the additional function selected by said selecting means; control means for controlling mutual transfer of counts between said second counting means and said storage means; correcting means for allowing said selecting means to select the time correcting function and for storing a desired time adjusted by said second counting means in said preset counter; main display means for normally indicating present time; sub display means for normally indicating an alarm time; and switching means for switching the indication of said main display means to the additional function selected by said selecting means and the indication of said sub display means to that of the present time.

* * * * *